US006510972B1

(12) United States Patent
Briskey

(10) Patent No.: US 6,510,972 B1
(45) Date of Patent: Jan. 28, 2003

(54) BILLED CAP STORAGE AND SHAPING DEVICE

(76) Inventor: Charles E. Briskey, 786 Eagle Ridge Trail, Stillwater, MN (US) 55082

( * ) Notice: Subject to any disclaimer, the term of this patent is extended or adjusted under 35 U.S.C. 154(b) by 6 days.

(21) Appl. No.: 09/607,040

(22) Filed: Jun. 29, 2000

(51) Int. Cl.[7] ..... A42C 1/00
(52) U.S. Cl. ..... 223/24; 223/84
(58) Field of Search ..... 223/24, 25, 85, 223/84, 12; 211/30, 32, 33

(56) References Cited

U.S. PATENT DOCUMENTS 5,012,531 A 5/1991 Schoonover ..... 2/185 B
5,022,515 A * 6/1991 Agostine ..... 206/8
5,074,410 A * 12/1991 Fries et al. ..... 206/8
5,172,837 A * 12/1992 Finney, Jr. et al. ..... 223/23
D355,600 S * 2/1995 Ford ..... D9/415
5,480,023 A 1/1996 Puller ..... 206/8
5,813,546 A * 9/1998 Wilson et al. ..... 211/32
5,991,927 A * 11/1999 Barbaccia ..... 2/209.13

* cited by examiner

*Primary Examiner*—Bibhu Mohanty
(74) *Attorney, Agent, or Firm*—Nawrocki, Rooney & Sivertson, P.A.

(57) ABSTRACT

The present invention is a storage and shaping device for caps having a bill. The device is comprised of a cavity that is sized to accommodate at least one billed cap. The cavity has an opening on one end that allows for the insertion of caps into the device. A portion of the cavity is provided as a bill shaping structure.

16 Claims, 4 Drawing Sheets

BILLED CAP STORAGE AND SHAPING DEVICE

BACKGROUND OF THE INVENTION

The present invention relates generally to the field of cap storage devices. In particular, the present invention relates to a cap storage device for the storage and shaping of caps having bills, such as baseball caps and the like. The storage device provides a shape forming structure that is utilized to enable the bills of caps to be formed and maintained in a desired shape.

Typically, caps, such as those traditionally worn in baseball, have a bill that is generally planar when it is fabricated. However, as is particularly well known with respect to the sport of baseball, it has been desirable to shape the bill of a billed cap to have an arched shape, wherein the side edges of the bill are lower than the middle of the bill. Thus, when viewed from the front, the bill is arched.

In the past, a popular method of obtaining such a desired shape was to place a baseball under the bill of the cap, and then, bind the bill around the surface of the ball, typically with a rubber band. Another method used, is to place the bill of a cap into a cup having the inner circumference that is desired for the arch of the bill and maintaining it in that position until the bill conforms to the arched shape.

Since the bill's natural configuration is to be planar in shape, the bill will slowly straighten when it is not being constrained by one of the above shaping methods. Furthermore, although these methods of shaping the bill of a hat may work to achieve a desired arched shape, the caps cannot easily be stored in this configuration.

Therefore, a need exists for a device that shapes the bill of a cap to a desired shape and acts to maintain the desired shape of the cap while the cap is compactly stored within the device.

The present invention addresses these needs, as well as other problems associated with the shaping and storing of billed caps.

SUMMARY OF THE INVENTION

The present invention relates to a storage device for caps having a bill. The device is comprised of a cavity that is sized to accommodate at least one billed cap. The cavity has an opening on one end to allow for the insertion of caps into the device. The device also has a portion of the cavity configured for bill shaping. The cap storage and shaping device provides a means of storing the cap and protecting the cap from damage, while providing a device for shaping the bill and maintaining the bill in the desired shape while in storage. In this way, the cap can be stored and, when removed, the bill has the same desired shape as when it was last worn by the user.

The above mentioned benefits and other benefits of the invention will become clear from the following description by reference to the accompanying drawings.

DESCRIPTION OF THE PREFERRED EMBODIMENT

Figure 6A:
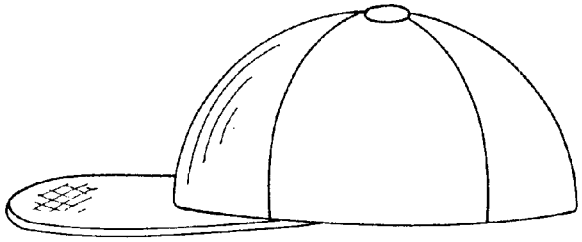
FIG. 6*a* is a side perspective view of a billed cap as manufactured.
Figure 6B:
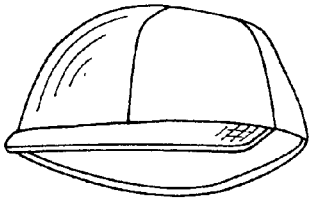
FIG. 6*b* is a front perspective view of the cap of FIG. 6*a*.
Figure 7A:
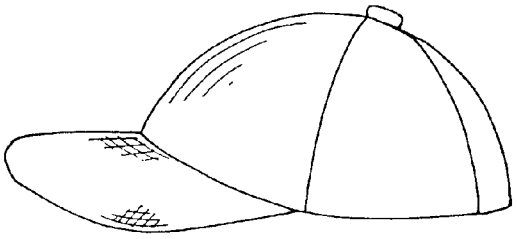
FIG. 7*a* is a side perspective view of a cap having the desired arched bill.
Figure 7B:
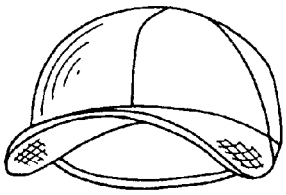
FIG. 7*b* is a front perspective view of the cap of FIG. 7*a*.

As shown in FIGS. 6*a* and 6*b*, a typical billed cap, such as a baseball cap, has a crown portion 38 and a bill portion 40 and is generally manufactured with a planar bill. The present invention relates to a cap storage and shaping device for use with billed caps, such as baseball caps and the like. The bill shaping device, as shown in FIG. 1, forms the bill and cap as shown in FIGS. 7*a* and 7*b*, having an arched bill.

Figure 1:
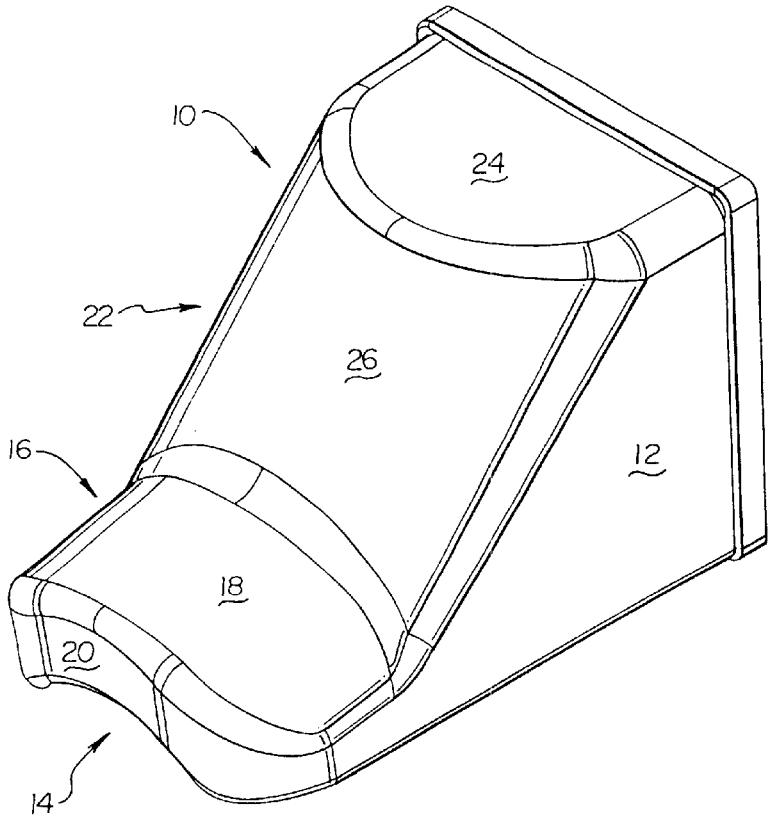
FIG. 1 is a front angled perspective view of the preferred embodiment of the invention.
Figure 2:
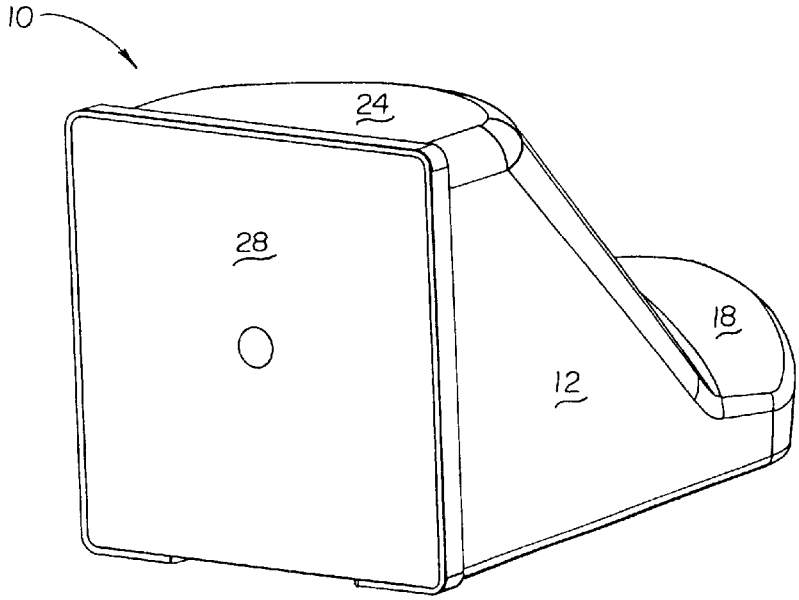
FIG. 2 is a rear angled perspective view of the device of FIG. 1 with a lid fastened thereto.
Figure 4:
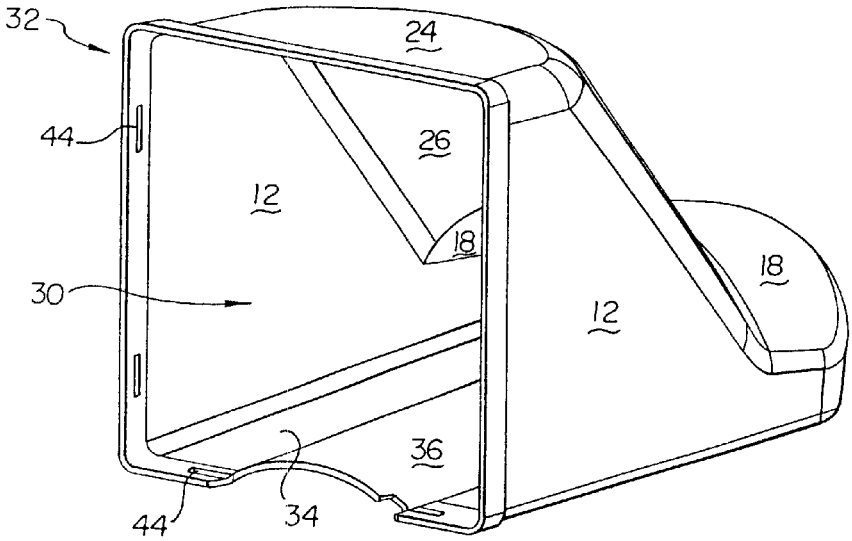
FIG. 4 is a rear angled perspective view of the device of FIG. 1 with the lid removed.

The device 10, as shown in FIGS. 1, 2, and 4, comprises a container having a cavity 30, formed therein, for the storing and shaping of billed caps. The container is preferably comprised of a rigid, thermoplastic material. This material may be utilized for the entire container or for the bill forming portion of the device. It is preferred that an entirely rigid container be utilized. Using this construction, the container protects the caps from dust and dirt, is rugged for easy transportation of the caps, protects the caps from damage and crushing, and can be utilized as a display for displaying caps.

The container includes two spaced apart side surfaces 12 and a bottom surface 34. The cavity 30 defines two portions, namely, a bill portion 16 and a crown portion 22. The cavity 30 has a portion formed to define a bill shaping and shape maintaining structure 14. The structure 14 is generally comprised of the side and bottom surfaces 12 and 34 and the bill portion 16 of the container. These features work to urge the bill of the cap into a flexed condition, thereby forming the bill into a desired arched configuration.

The side surfaces 12 of the device are utilized to urge the bill into an upward arched configuration. This is accomplished by spacing the side surfaces apart at a distance that is less than the width of a bill to be placed within the device. Bills of caps may vary in width, and therefore, so may the width of the device, however, the device as shown is constructed to accommodate a standard baseball cap bill width of approximately 7 inches. The width of the device, as shown, is approximately 5.5 inches. The ratio of the widths may be varied depending upon the amount of bill curvature desired. For example, if it is desired that a standard bill have a greater arch curvature, then the device can be constructed having a smaller width.

As shown in FIG. 1, the preferred embodiment of the bill portion 16 is comprised of a top surface 18 and a front surface 20. The top surface 18 of the bill portion 16 is preferably arched to accommodate the bill in its flexed condition. The top surface 18 of the bill portion may be generally parallel to the bottom surface 34, but is preferably angled upward slightly from its front edge to its back edge.

As shown, the top surface 18 is angled approximately 10 degrees from parallel to the bottom surface 34.

The bottom surface may be comprised of a generally planar, generally horizontal surface, however, as shown in FIG. 4, the bottom surface 34 may have an arched portion 36 that may be utilized in the formation and support of the arched shape of the bill. The arched portion may extend across the entirety of the bottom surface or, as shown, may only extend across the center of the bottom surface 34. The bottom surface 34 of the device may also be sloped slightly upward from back to front. As shown, the bottom surface is sloped approximately 0.5 degrees. If an arched portion 36 is utilized, that portion may also be sloped to provide better support for the caps. As shown, the arched portion 36 is sloped upward from back to front approximately 2 degrees.

The front portion 20 is preferably generally normal to the bottom surface 34, but may be tapered slightly forward from its bottom edge to its top edge. As shown, the front edge is tapered approximately 10 degrees from normal.

Figure 7C:
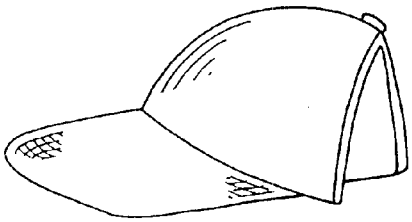
FIG. 7*c* is a side perspective view of a cap with the rear of the crown portion folded into the front crown portion.

The crown portion 22 is defined by the side surfaces 12 and the bottom surface 34 as well as a top surface 24 and a front surface 26. The crown portion of the device is provided to house the crown of a cap. Preferably, as shown in FIG. 7*c*, the rear section 42 of the crown of the cap is folded into the front section of the crown of the cap. In this configuration, the cap is more compact and is easier to store. Furthermore, several caps may be nested, having the cap's bill and front crown surface resting upon the surfaces of the next cap and inserted into the device, thereby storing and shaping several caps at once.

The top surface 24 of the crown portion 22 works with the side and bottom surfaces 12 and 34 to form a space to accommodate the crown of at least one cap. The top surface 24 of the crown portion is preferably a planar surface that is generally parallel to the bottom surface and, as shown, is approximately 4 inches in length. The front edge of the top surface 24 is preferably curved to accommodate the curved configuration of the front surface of the crown of a cap. The front surface 26 of the crown portion 22 connects the top surfaces 18 and 24 of the crown portion and the bill portion together. The front surface 26 is preferably sloped downward from the top surface 24 of the crown portion to the top portion 18 of the bill portion and preferably has a curved surface, as shown in FIG. 4, to accommodate the curvature of front surface of the crown of a cap.

The device 10 may be sized to accommodate one cap or several caps. As shown, the device 10 can comfortably accommodate three standard baseball caps. The overall length of the device, as shown, is approximately 9.5 inches. The opening into the cavity is approximately 5.5 inches and is preferably square in shape. The front surface of the bill portion, as shown is approximately 1.5 inches, thereby accommodating at least three caps.

Figure 3:
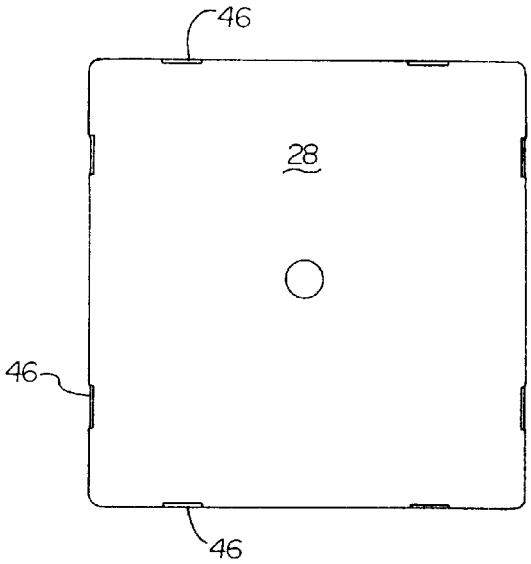
FIG. 3 is an overhead view of the lid of FIG. 2.
Figure 5:
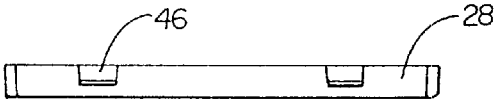
FIG. 5 is an side perspective view of the lid of FIG. 3.

As shown in FIGS. 2, 3, 5, 8, and 10, the device 10 also preferably has a lid 28 that may be fastened to the opening 32 of the cavity 30 to secure and protect the caps within the device. The lid 28 may be attached to the device 10 in any manner known in the art. One example of a fastening mechanism is shown in FIGS. 3, 4, and 5. As shown, the lid 28 is sized to fit within the opening 32 of the cavity 30. The device 10 has a lip around the opening 32 for engaging the edge of the lid 28. At the center of the bottom of the opening 32, there is a gap in the lip, that is provided to enable the user to better grasp and remove the lid 28 from the opening 32. The lip has tabs 44 that extend outward from the surface of the lip. When the lid 28 is placed into the opening 32, the tabs 44 are engaged into slots 46 formed on the edge of the lid 28.

Figure 8:
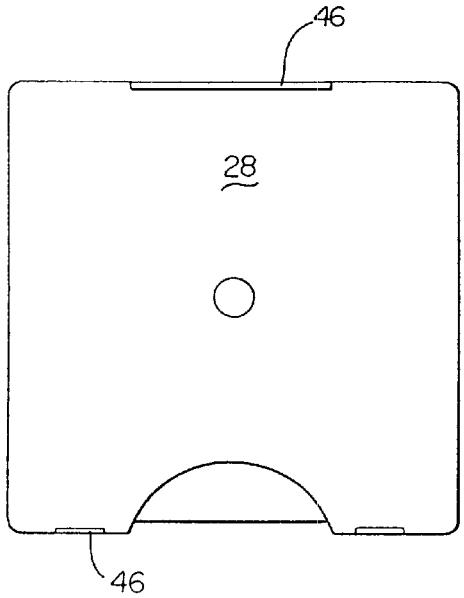
FIG. 8 is an overhead view of a second lid closure structure.
Figure 9:
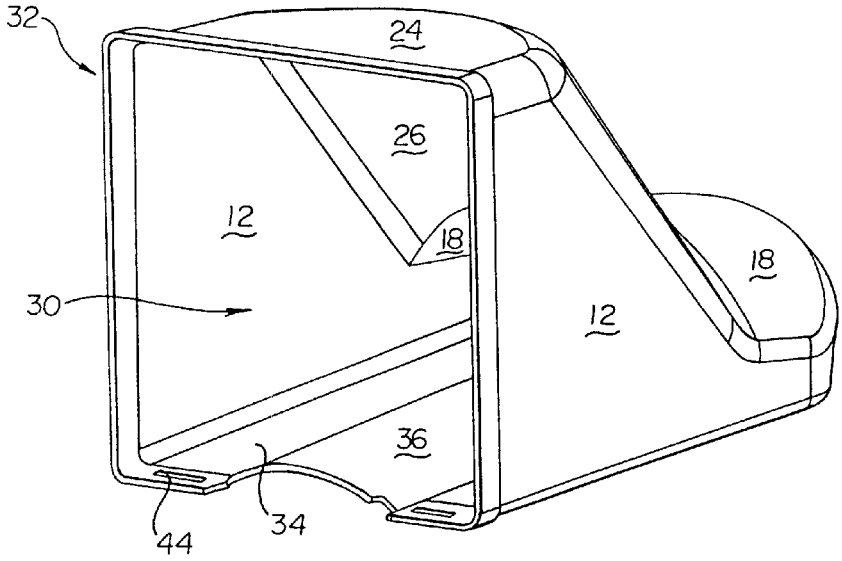
FIG. 9 is a rear angled perspective view of the device of FIG. 8 with the lid removed.
Figure 10:
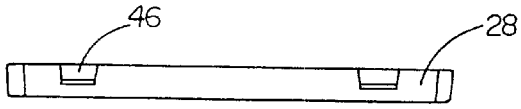
FIG. 10 is an side perspective view of the lid of FIG. 9.

Another example of a closure means utilizing a tab-slot mechanism, to secure the lid, is shown in FIGS. 8, 9, and 10. In this embodiment, the lid 28 has three slots 46, two small slots on the bottom edge of the lid 28 and one large slot across the center of the top edge of the lid 28. These slots 46 are interfaced with corresponding tabs 44 formed on the lip of the opening 32. The center of the bottom edge of the lid 28 has been moved closer to the middle of the lid and has recessed in an arcuate shape, to provide a better hand hold for opening the device.

Since many possible embodiments may be made of the present invention without departing from the scope thereof, it is to be understood that all matter herein set forth or shown in the accompanying drawings is to be interpreted in the illustrative and not a limiting sense.

What is claimed is:

1. A storage and shaping device for standard baseball style caps having a bill, comprising:

a container sized to retain a plurality of standard baseball style caps therein, said container having opposing planar sidewalls and an open end terminating in a rim, said rim comprising portions of said opposing planar sidewalls, and a bill shaping portion opposite said open end, said bill shaping portion having a lateral extent less than that of a bill of a standard baseball style cap; and a lid selectively receivable upon said rim of said container such that said lid engages at least portions of said opposing sidewalls of said container.

2. A cap storage device comprising:

a rectilinear container having a cavity sized to receive and retain a plurality of standard sized baseball style caps, said container shaped to define a crown portion and a bill portion, said bill portion configured to laterally restrict, shape, and maintain a bill of a standard sized baseball style cap in an arched condition, said crown portion having a free end defining a rim for said container, said rim being adjacent said cavity; and a lid selectively receivable upon said rim.

3. The device according to claim 2, wherein said crown and bill portions have at least two side surfaces and front and top surfaces, said top surface of said bill portion being arched upward between said side surfaces, said top and side surfaces of said bill portion constructed and arranged to force and accommodate the bill portion of a cap into an arched configuration.

4. The device according to claim 2, wherein said crown and bill portions have a common bottom surface.

5. The device according to claim 4, wherein said bottom surface is constructed and arranged having at least a portion of its surface in an arched configuration.

6. The device according to claim 5, wherein said lid is selectively receivable upon an interior portion of said rim.

7. The device according to claim 5, wherein said lid is selectively receivable upon an exterior portion of said rim.

8. The device according to claim 2, wherein said container is made of a rigid material.

9. The device according to claim 2, wherein said crown portion has a top surface and a front surface, said front surface extends between said top surface of said crown portion and said top portion of said bill portion.

10. The device according to claim 9, wherein said front surface is angled downward from said top surface of said crown portion to said top surface of said bill portion.

11. The device according to claim 10, wherein said front surface is outwardly arched between said side portions.

12. The device according to claim 4, wherein said bottom portion of said container comprises two planar surfaces spaced apart by an upwardly arched panel interposed therebetween.

13. A cap storing device, comprising:

a container having an interior surface shaped to define adjoining bill and crown portions, said container adapted to receive and house a plurality of caps having standard sized baseball style bills, said container having opposed side surfaces and a mouth, portions of said opposed side surfaces being adjacent said mouth, said bill portion having a lateral extent less than that of a bill of a standard baseball style cap.

14. The device according to claim 1, wherein said lid has a handle integrated therein.

15. The device according to claim 2, wherein said bill portion is defined by a connection of at least one bottom portion with two side portions of said container, said interconnection forming a corner for receiving a lateral edge of the bill of a standard sized baseball style cap and thereby maintaining the bill in an arched configuration.

16. The device according to claim 13, wherein said device further comprises a lid adapted to selectively cover said mouth.

* * * * *